US005202654A

United States Patent [19]

Heine

[11] Patent Number: 5,202,654

[45] Date of Patent: * Apr. 13, 1993

[54] MULTI-STAGE MONOLITHIC CERAMIC BANDSTOP FILTER WITH ISOLATED FILTER STAGES

[75] Inventor: David R. Heine, Albuquerque, N. Mex.

[73] Assignee: Motorola, Inc., Schaumburg, Ill.

[ * ] Notice: The portion of the term of this patent subsequent to Dec. 22, 2009 has been disclaimed.

[21] Appl. No.: 733,584

[22] Filed: Jul. 22, 1991

[51] Int. Cl.[5] ..... H01P 1/205

[52] U.S. Cl. ..... 333/206; 333/202

[58] Field of Search ..... 333/202, 206, 207, 222, 333/32

[56] References Cited

U.S. PATENT DOCUMENTS 4,673,902 6/1987 Takeda et al. ..... 333/202
4,742,562 5/1988 Kommrusch ..... 333/206 X
4,823,098 4/1989 DeMuro et al. ..... 333/202 X

FOREIGN PATENT DOCUMENTS 0179603 8/1986 Japan ..... 333/222
0055402 2/1990 Japan ..... 333/202

*Primary Examiner*—Robert J. Pascal
*Assistant Examiner*—Seung Ham
*Attorney, Agent, or Firm*—Joseph P. Krause

[57] ABSTRACT

A multi-stage ceramic bandstop filter electrically isolates coupling between stages in a monolithic block of ceramic material (21) by including holes (32 and 36) between the resonator stages (30, 34, and 38) that are shorted at both the top and the bottom ends, that are coated with conductive material and that behave as electrical shields between the succeeding resonator stages electrically isolating and reducing signal coupling between stages. Isolation between stages is also provided by impedance inverting lengths of transmission line (50 and 52) that coupled the stages together.

19 Claims, 2 Drawing Sheets

MULTI-STAGE MONOLITHIC CERAMIC BANDSTOP FILTER WITH ISOLATED FILTER STAGES

FIELD OF THE INVENTION

This invention relates to electrical filters. More particularly, this invention relates to so-called monolithic ceramic filters, which that are particularly useful at high frequencies and that are formed from monolithic blocks of ceramic material. More particularly, this invention relates to a ceramic, multi-stage bandstop filter formed within such a block of material, wherein successive stages are electrically isolated from each other.

BACKGROUND OF THE INVENTION

Electrical filters are well known in the art. Filters are generally grouped as either lowpass, highpass, bandpass, or notch (also known as bandstop) filters. Lowpass filters suppress electrical signals above a particular desired cutoff frequency, passing only signals below, or lower than, the cutoff frequency. Highpass filters suppress electrical signals below a particular cutoff frequency, passing only signals above, or higher than, the cutoff frequency. Bandpass filters pass electrical signals between two cutoff frequencies. Notch, or bandstop, filters suppress electrical signals between first and second cutoff frequencies.

Implementation of the various types of electrical filters is also well known in the art. Depending upon the performance specifications required of a filter, electrical signal filtering can be performed using either passive components such as resistors, capacitors, and/or inductors, but may also include certain active components as well.

At relatively low frequencies, i.e., below 200 MHz, electrical filters are typically comprised of passive components and are usually so-called lumped elements, i.e., inductors are typically wire-wound devices and capacitors are typically parallel plate devices separated by either air or some other dielectric material. It's well known that at high frequencies, i.e., above 200 MHz, lumped elements do not behave very well, i.e. electrical characteristics are affected by many factors including the physical dimensions of the devices and their physical layout. At high frequencies, even a length of lead wire on a wire-wound inductor will itself have inductance that adds to the inductance of the coil windings and is an inductance which must be taken into account in the design and manufacturing of the device.

So called ceramic block filters have recently become popular in many applications because of their performance characteristics at high frequencies, their manufacturability, their reduced size (compared to lumped elements) and their inherent ruggedness. Ceramic block filters are well suited to perform either lowpass, highpass, bandpass, and bandstop functions at high frequencies. These devices are particularly well suited at high frequencies because they typically employ quarter wavelength sections of transmission line to achieve the functions of discrete or lumped components used at lower frequencies.

Ceramic bandpass filters are well known in the art and have been the subject of numerous patents in the United States. These devices are typically comprised of several quarter-wavelength sections that are configured to pass a relatively narrow band of signals and reject signals outside this band of frequencies. When implementing a bandpass filter in a monolithic block of material, (i.e., a single solid block of material) interstage coupling of passband signals improves the filters characteristic response by coupling more of the desired frequency signals from an input terminal to an output terminal while suppressing signals outside the passband.

In a bandstop or notch filter that suppresses signals between two frequencies, a bandstop filter that uses several cascaded stages can provide wider, more highly attenuating stop bands, than a filter using only one notch filter stage. In a multistage notch filter, interstage signal coupling of signals can permit undesired frequency signals to leak or couple from the filter input to the filter output. Depending upon the desired characteristics of a multistage notch filter, optimum performance can frequently be realized only when signal coupling between stages (interstage signal coupling) is minimized. Minimizing the interstage signal coupling between stages in a multi-stage notch filter improves the performance of the filter by having all of the signals to be suppressed, pass through the succeeding stages of the filter, each of which further attenuates undesired signals, further reducing their energy levels at the filter output. Stated alternatively, if a signal to be attenuated is allowed to couple from an input port of a filter to an output port of the filter, bypassing filter stages, signal attenuation will be reduced because of the filter stages that the signals bypass.

In monolithic ceramic block filters, a certain amount of coupling from the input port to the output port always exists by virtue of the fact that the filter is comprised of a single block of material from which some capacitance between an input terminal and an output terminal will always be realized. In the prior art, multistage ceramic notch filters used stages that were physically isolated from each other to achieve electrical isolation. Electrical isolation between stages in a multistage ceramic notch filter was typically accomplished by physically separating stages into several blocks, each block being electrically isolated by metal shielding provided by some type of sheet metal or physical distance separating the succeeding stages such that input signals could not readily couple to the filter output.

In the prior art wherein successive stages in a multistage notch filter were physically separated from each other, space was wasted separating the stages from each other but more importantly, filter manufacturing was more difficult and hence more costly. In applications where circuit board space is at a premium and where a multistage notch filter is called for, a multistage ceramic filter that is embodied within a single or monolithic block of material would be an improvement over the prior art. Accordingly, a monolithic ceramic block filter that has a notch or a bandstop response characteristic, that is implemented in a single block of material, and that improves isolation between filter stages without having to rely on physical spacing and/or shielding between stages would be an improvement over the prior art.

SUMMARY OF THE INVENTION

There is provided a multi-stage monolithic ceramic block bandstop (also known as a notch filter) filter that is comprised of a single block of dielectric material. Individual stages of the filter are isolated from each other by de-coupling stages that are fabricated into the block, which are plated holes in the block that are physically located in the block between filter stages.

The block is formed to include a plurality of holes that extend through it. The interior surfaces of the holes and the exterior surfaces of said block, with the exception of a single top surface, are covered with a conductive material. The coated surfaces of the block together with printed patterns of conductive material on the uncoated top surface form a plurality of shortened coaxial resonators, electrically isolated from each other by one or more holes in the block the interior surfaces of which that are completely coated and coupled to electrical ground. These holes that are between the shortened coaxial resonators and coated with material comprise passive shielding elements of the notch filter, within the ceramic block, electrically isolate the shortened coaxial resonators from each other, thereby reducing interstage coupling of electrical signals from one resonator to another and thereby improving the frequency response characteristic and attenuation in the notch band.

DESCRIPTION OF A PREFERRED EMBODIMENT

Figure 1:
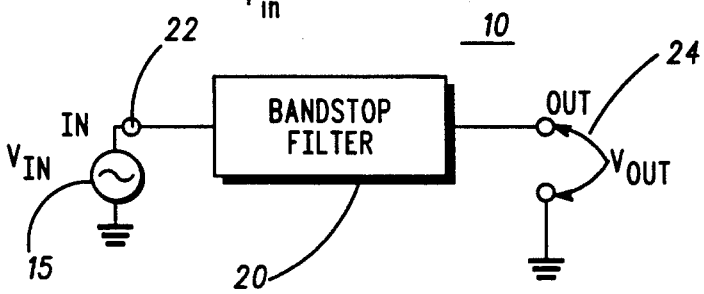
FIG. 1 shows a simplified electrical device comprised of a source of electrical signals and a bandstop filter.

FIG. 1 shows a simplified electrical apparatus (10), which might be a circuit used in a radio communications device for example. In this simplified electrical device (10), a source of electrical signals (15) that has output signals across a wide range of frequencies, is coupled to an input port (22) of an ideal bandstop filter (20), which rejects (suppresses from the signals present at its output port 24) all frequencies between first and second cutoff frequencies. The filter (20) couples to its output port (24), all the signals from the source (15), with the exception of the signals having frequencies in the band of rejected signals. (All signals above $F_1$ and below $F_2$ are suppressed, as shown in FIG. 2.)

Figure 2:
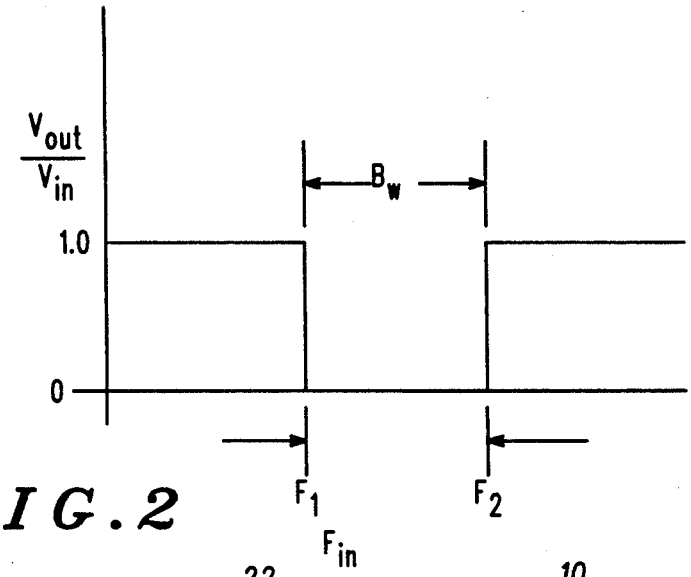
FIG. 2 shows the response of an ideal bandstop filter.

FIG. 2 shows the transfer function of an ideal bandstop filter, including the bandstop filter (20) shown in FIG. 1. In FIG. 2 the transfer function of $V_{out}/V_{in}$ is unity across all frequencies except those frequencies between $F_1$ and $F_2$ whereat the transfer function $V_{out}$ over $V_{in}$ is equal to zero. Between these two frequencies, (above $F_1$ and below $F_2$) the bandstop filter completely suppresses electrical energy. Below $F_1$ and above $F_2$, the filter (20) passes these signals without attenuation. (It should be noted that the transfer function shown in FIG. 2 is that of an ideal bandstop filter and, in reality, virtually all filter implementations show some roll-off as they approach cutoff frequencies. Filter characteristics are well known in the art.)

Figure 3:
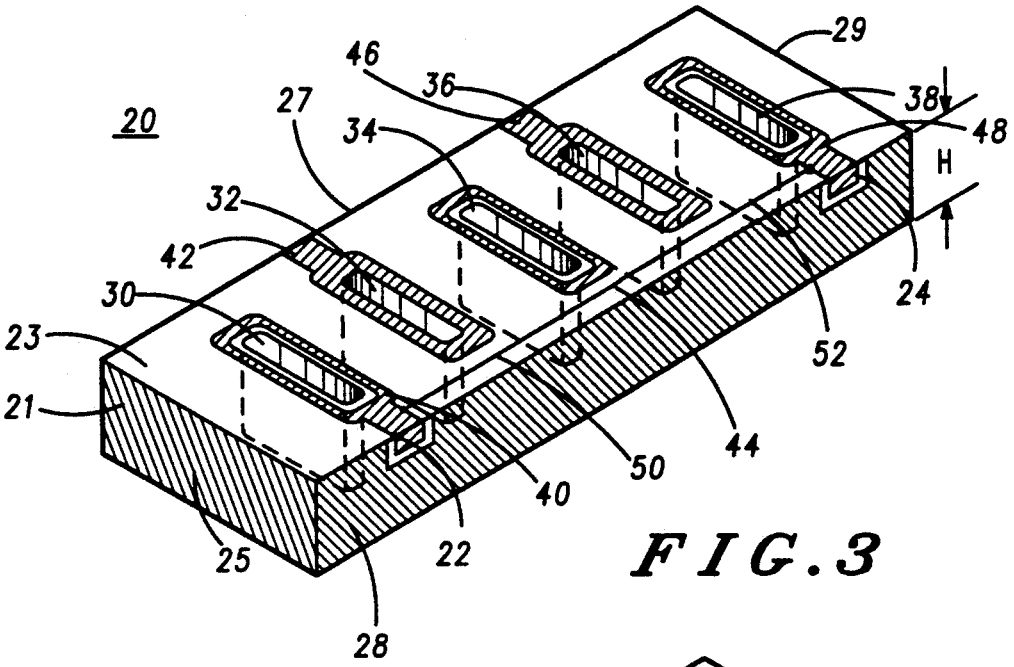
FIG. 3 shows an isometric view of one embodiment of a multi-stage monolithic ceramic block filter with integral isolation between stages.

FIG. 3 shows an isometric view of one implementation of a multi-stage monolithic bandstop filter that has improved frequency response characteristics because of inter-stage electrical isolation accomplished between succeeding stages of the filter. The filter shown in FIG. 3 has three cascaded stages, each of which is a series resonant circuit having a very low impedance at frequencies close to their resonant frequencies that short signals at these frequencies to ground. Each stage attenuates electrical signals between the cutoff frequencies ($F_1$ and $F_2$) by some amount.

In FIG. 3 the bandstop filter (20) is comprised of a monolithic block of dielectric material (21), which is a monolithic block of material (21) that is substantially a parallelpiped having six external surfaces, a top surface (23), a bottom surface (25), a left-side surface (26), a right-side surface (29), a rear surface (27), and a front surface (28). With the exception of the top surface (23) all these external surfaces are coated with a layer of conductive material, which in the preferred embodiment was comprised of silver. The conductive layers on the sides are electrically common, forming a continuous layer of conductive material on all sides but the top.

Three foreshortened quasi-coaxial transmission lines are formed within the block that each have physical lengths that are, at the resonant frequencies of the filter, (i.e., $F_1$ and $F_2$) electrically, slightly less than one-quarter the wavelength of signals at these frequencies. In the preferred embodiment, these shorted transmission lines phase shifted sending end input signals by approximately 81 degrees between $F_1$ and $F_2$. As is well-known in transmission line theory, these shorted coaxial transmission lines (formed by plated holes 30, 34, and 38) acted as inductors at these frequencies. These resonators are formed by electrically conductive material coating the interior surfaces of the dielectric material of the block within the holes (30, 34, and 38) and they extend completely through the block of material (21), through the top surface (23) and the bottom surface. (25). As stated above, with the exception of the top surface (23), all the exterior surfaces (21, 25, 28, 29, and 26) are covered with a layer of conductive material. Since the exterior surfaces (21, 25, 28, 29, and 27) are electrically equivalent to ground with, (with the exception of the top surface which is only coated with predetermined patterns, as shown) electrically coupling the conductive material lining the holes at the bottom ends (The ends of the holes proximate to the bottom surface of the block.) of the holes (30, 34, and 38) to the material coating the external surfaces (21, 25, 28, 29, and 27) makes the conductive material lining the holes, form lengths of shorted transmission line, the physical lengths of which are equal to the height, H, of the block. If the electrical length of these lines is selected to be less than exactly one quarter-wavelength of the signals near $F_1$ and $F_2$, these lengths of transmission line will act as inductors.

If the resonators formed by the coating within the holes 30, 34, and 38 are inductors at or near the frequencies of the filter, (with their bottom ends shorted to ground) series resonant circuits are readily constructed by series connecting capacitors to the top ends of these resonators. Referring to FIG. 3, there can seen surrounding the top ends of each of the holes 30, 34, and 38, small bands of metallization (40, 44, 48) that are close to the edges of the holes (30, 34, and 38) but that do not actually contact the edges of these holes. This metallization and the metallization on the surfaces of the holes (30, 34, and 38) forms a capacitor that is electrically in series with the inductance provided by the resonators. The series connected capacitors and inductors in turn form series resonant circuits that are resonant near $F_1$ and $F_2$ and that short signals between these frequencies to ground, attenuating them.

Electrical signals are coupled into the first one of these plurality of series resonant stages through an input port, which is comprised of a conductive pad (22) on one side of the block (21), (the front side (28) of the block (21) shown in FIG. 3). The conductive pad (22) is electrically isolated from the grounded material coating the front surface (28) of the block (21) by a small, unmetallized region surrounding the input/output pad (22), as shown in FIG. 3.

Signals on the conductive pad (22) see a series-resonant circuit comprised of the layer of conductive material (40) that surrounds the perimeter of the opening of the hole (30), forming a capacitor, and the inductance provided by the first of the shorted coaxial resonators formed by the conductive coating within hole (30). Between $F_1$ and $F_2$ the impedance of this series resonant circuit is very low.

Electrical signals from this first stage are coupled to a second stage through an inductor (50) which in the embodiment shown in FIG. 3 is a length of wire (50) physically coupled to a section of the conductive coating near the input/output pad (22) to a layer of conductive material (44) surrounding the perimeter of the second shorted coaxial resonator stage formed by the hole (34). The second filter stage, which is also a series-resonant LC circuit, is formed by the coating on the interior surfaces of the hole (34), which is also a shorted length of transmission line that acts as an inductance between $F_1$ and $F_2$. and the capacitance between the metallization of hole 34 and the band of metallization (44) surrounding hole 34 but not contacting metallization within the hole.

In order that each of these resonant circuits act independently, (for wider and more highly attenuating stop bands) they should be de-coupled, or isolated, from each other, but while still maintaining a complete circuit from the input (22) to the filter's output for those signals less than $F_1$ and greater than $F_2$.

Electrical isolation between the first and second stages is accomplished by means of the metallization in the intermediate hole (32) between these first and second stages. The surfaces within the hole (32), which is itself also completely coated with conductive material but is shorted at both ends to electrical ground potential, substantially forms a layer of electrical material, shielding the first filter stage from the second filter stage. It can be seen in FIG. 3 that the conductive material (42) surrounding the parameter of the hole (32) is coupled to the conductive material covering the exterior surfaces of the block (21). As such this hole (32) is grounded at both ends and suppresses electrical signals at the first resonator stage from the second resonator stage.

An impedance inverting circuit (comprised of the inductor 50 and capacitances to ground at each of the inductor 50) couples signals from the first filter stage to the second filter stage while isolating the stages from each other. This impedance inverting circuit is accomplished by the inductor 50 and its associated capacitances, and is electrically equivalent to a quarter-wavelength transmission line, which as is also well-known, performs as an impedance inverter.

(An impedance inverting transmission line as such, has first and second ends. The value of an impedance at the first end, appears at the second end, to be substantially equal to the mathematical inverse of the value at the first end, and vice versa. If the two conductors of an impedance inverting transmission line are shorted together at the first end, the first end impedance is considered to be zero ohms. The second end impedance will therefore be very high, or near infinity, appearing to be an open circuit. Conversely, if the first end impedance is infinity, as when the two conductors are each not connected to anything, the second end impedance will be near zero.)

The low impedance to ground provided by the first filter stage (formed by the metallization 40 and by metallization in hole 30) is transformed to a high impedance at the second filter stage (formed by the metallization 44 and metallization in hole 34) by the impedance transformation effected by resonator 50 and its associated capacitance. The parallel combination of this high impedance and the low impedance to ground effected by the second filter stage is substantially equal to the low impedance of the second filter stage. It should be apparent that, looking into inductor 50 from the first filter stage, the first filter stage sees a high impedance from inductor 50 (by virtue of the inversion of the low impedance provided by the second filter stage) while the second filter stage also sees a high impedance from inductor 50, looking toward the first filter stage (by virtue of the inversion of the low impedance provided by the first stage). Thus it should be apparent that inductor 50, in combination with its capacitances (which will be more fully pointed out below with reference to FIG. 6) isolates the stages from each other.

Electrical signals that are coupled to the second filter stage from the first filter stage are attenuated further in a third filter stage. The third stage is formed by the metallization lining hole 38 and the metallization (48) surrounding hole 38. The third stage is also a series resonant circuit, resonant between $F_1$ and $F_2$ providing at its resonant frequency a low impedance to ground and attenuating such signals. Isolation of the third stage from the second is accomplished by a second isolation hole (36), which electrically shields the third stage from the second, and by a second impedance inverter, coupled between the second and third filter stages. This second impedance inverter is comprised of a second inductor (52) that is a piece of wire coupled between the metallization (44) surrounding hole 34 and the metallization (48) surrounding hole 38 with associated capacitances at each end.

To signals at the second stage, (hole 34), which has a low impedance at resonance, the third stage impedance, (which at resonance is also low) appears to be very high by virtue of the impedance inversion provided by the impedance inversion between these two stages. To the third stage, which at resonance has a low impedance, the second stage impedance appears to be high. As explained above for the first and second stages, the, second and third stages are isolated from each other as well.

As explained above, signals from the first and second resonator stages (holes 30 and 34) are shielded from each other by the metallization lining the hole between them (hole 32), which is shorted to ground, (the metallization on the other exterior surfaces 23, 25, 26, 27, 28 and 29 of the block 21) at both its ends. Signals from the second and third resonator stages are shielded from each other by another hole (36) positioned between these second and third stages that is itself also shorted at both ends to ground forming an electrical shield between the two resonator stages formed within holes (34 and 38).

Output signals from the filter (20) are taken off the multi-stage monolithic ceramic notch filter from a second input/output pad (24), that is also located on the front surface (28) of the block (21) and isolated from metallization on these surfaces by the small unmetallized area surrounding the input/output pad (24) as shown.

Figure 4:
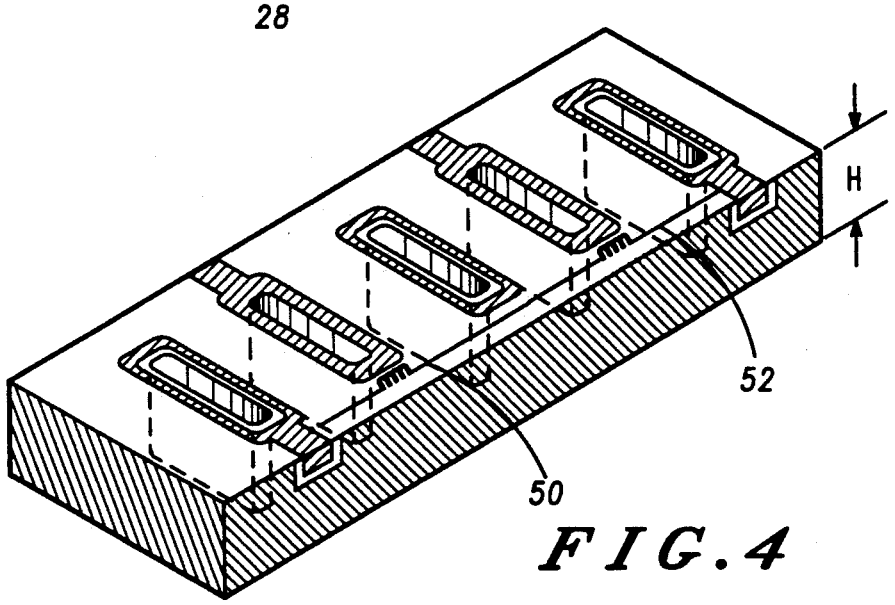
FIG. 4 shows an alternate embodiment of the device shown in FIG. 3.
Figure 5:
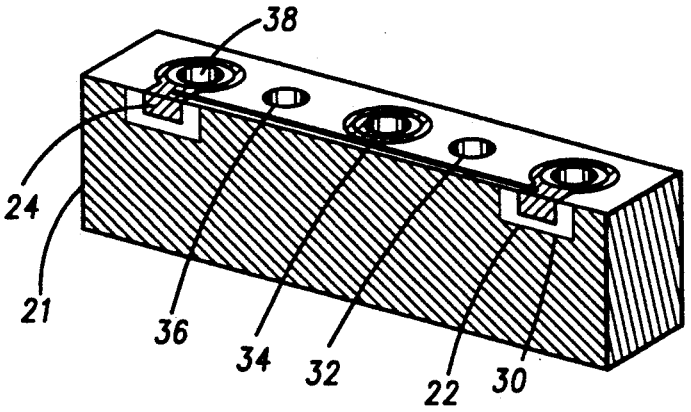
FIG. 5 shows an isometric view of another embodiment of the monolithic ceramic block multi-stage notch filter.

In the embodiment shown in FIG. 3, the interstage inductors (50 and 52) are wires. At different frequencies, alternate embodiments as shown in FIG. 4 might use wire wound inductors to couple these stages together. Still another embodiment, shown in FIG. 5, might use printed layers of conductive material on the top surface (23) of the block (21) to electrical couple the resonator stages together. In FIG. 5, the conductive material printed onto the top surface is typically a silver or other conductive paste that can be screen printed. (The embodiment shown in FIG. 5 uses circular cross-sectioned holes unlike the holes shown in FIGS. 3 and 4 which are substantially elliptical.) Furthermore, in FIG. 5, the input/output pads (22 and 24) are shown on the top surface (21) of the block.

Figure 6:
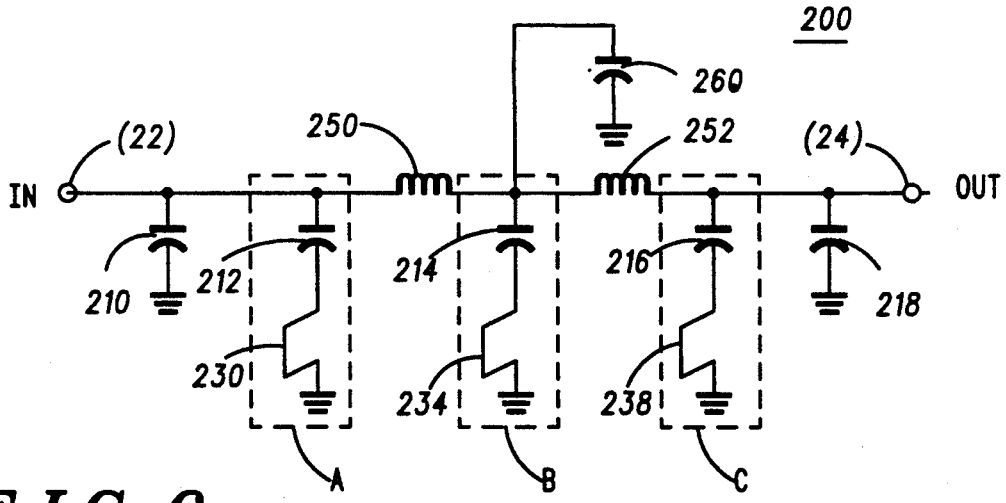
FIG. 6 shows a schematic diagram of the electrical equivalent circuit of the devices shown in FIGS. 3, 4, and 5.

FIG. 6 shows an electrical equivalent schematic diagram of the embodiments shown in FIGS. 3, 4, and 5, is shown. The input pad (22) is clearly shown with a capacitor (210) to ground that is the capacitive coupling existing between the input/output pad (22) material, as well as the metallization layer (40) to the conductive layer on the exterior surfaces of the block that is electrically grounded.

The coupling capacitor (212) to the first resonator stage is the capacitance existing between the perimeter metallization (40) and the metallization on the interior of the surface of the first hole (30). In FIG. 6, the first shorted transmission line (230) is the metallization on the interior of the surface of the hole (30). The metallization on the interior of the hole (30) is connected to ground at the bottom end (25) at the lower end of the hole (30) at the bottom surface of the block (21).

The inductance (250) that couples the first filter stage A to the second filter stage B is the wire (50) or the inductors (50) or the printed traces that are shown in FIGS. 3, 4, and 5 respectively. This inductor (250) in combination with the capacitor (260) perform the impedance transformation of resonator stage A to resonator stage B. The inductor (250) and the capacitor (260) form an equivalent of a quarter wavelength transmission line that inverts the impedance of the second resonator stage B. The third filter stage C that is comprised of the capacitor (216) in series with the shortened coaxial resonator (238) is coupled to the second filter stage B through a second inductor (252) in combination with the capacitance (260). Capacitor (260) and inductor (252) again perform an impedance inverting function that inverts the impedance of the third filter stage C.

Capacitor 260 is, in part, the capacitance existing between the metallization layer (44) surrounding the middle hole (34) and the metallization on the external surfaces of the block. The wires (50 and 52), as well as the inductors or printed traces (as shown in FIGS. 4 and 5) will of course themselves have a distributed capacitance to ground, a part of which be represented by capacitor 260.

By virtue of the electrical isolation performed by the coated holes (32 and 36), as shown in FIG. 3, interstage coupling between filter stages A, B, and C is reduced and the frequency response of the notch filter is substantially improved over prior art dielectric notch filters. In the preferred embodiment, the holes in the block were substantially elliptical cross-sectioned, similar to the holes shown in FIGS. 3 and 4. The material chosen for the block of material (21) was barium tetratitanate ceramic having a dielectric constant $E_R$ equal to 37. The conductive coating on the outside of the block and on the inside of the cavities as well as the printed top patterning was made by firing on a silver paste supplied by any number of commercial vendors. The inductors coupling the successive shorted coaxial resonator stages were comprised of five turns of 10 mil wire with a 25 mil diameter.

As shown in FIG. 3 the height in the preferred embodiment was equal to 0.53 inches where the length L was equal to 0.49 inches and the width of the block was equal to 0.235 inches. The cavities were approximately equal to 0.116 inches by 0.034 inches spaced 0.084 inches center to center.

In the preferred embodiment the input capacitance (210) was approximately 2 picofarads. The capacitor (212) was approximately 1.47 picofarad. The impedance of the first resonator (230) was approximately 8.9 ohms at resonance. The capacitance (260) was approximately 2.7 picofarads and the inductance of L1 and L2 were both 11 nanohenries. The capacitor (214) was approximately 1.78 picofarads with the impedance of the second resonator equal to 9.1 ohms at resonance. Capacitor (216) was 1.38 picofarads with the impedance of the third resonator stage (238) equal to 8.9 ohms. The output capacitance (218) was approximately 2.56 picofarads. Using all these values and the dimensions described above the cavity resonator with the impedances as depicted were resonant at 838 MHz.

What is claimed is:

1. A multistage monolithic ceramic block bandstop filter for suppressing desired frequency electrical signals comprising:

a filter body comprised of a block of dielectric material having at least top, side, and bottom surfaces, said filter body having at least first and second holes extending through said filter body, said holes having first ends at the top surface of said block and second ends at said bottom of said block, said filter body and interior surfaces of said first and second holes being substantially covered with a conductive material forming an electrical ground, with the exception of said top surface, said coated interior surfaces of said first and second holes having first and second inductances and forming first and second inductors, shorted to ground at their second ends, at at least one frequency;

an isolator within said filter body, suppressing electrical coupling between said first and second inductors, comprised of a third hole extending at least partially through said block, located between said first and second holes, said third hole having a first end at said top surface and a second end at said bottom surface, surfaces within said third hole being substantially covered with conductive material that is electrically coupled at both said first and second ends to said conductive material coating surfaces of said filter body;

input means comprised of a conductive material surrounding the first end of the first hole, coupled to the first end of the first inductor, for capacitively coupling signals into said bandstop filter, for capacitively coupling electrical signals into the first end of the first inductor and for forming, at at least one frequency, a first series resonant circuit to ground with said first inductor;

output means comprised of a conductive material surrounding the first end of said second hole, coupled to the first end of the second inductor, for capacitively coupling electrical signals out of said bandstop filter, for capacitively coupling electrical signals into said second inductor and for forming, at at least one frequency, a second series resonant circuit to ground with said second inductor; and an impedance inverter means, coupled between the input and output means, having first and second ends, for providing an impedance at one end that is substantially the mathematical inverse of an impedance at the opposite end.

2. The filter of claim 1 where said impedance inverter means is comprised of a predetermined length of wire, electrically coupling said input and output means and said first and second inductors to each other.

3. The filter of claim 1 where said impedance inverter means is comprised of a predetermined length of printed conductive material on the top surface of the block, electrically coupling said input and output means and said first and second inductors, to each other.

4. The filter of claim 1 where said filter body is comprised of a block of dielectric material having the shape of a parallelpiped.

5. The filter of claim 1 where said first and second holes have substantially circular cross-sectional shapes.

6. The filter of claim 1 where said first and second holes have substantially elliptical cross-sectional shapes.

7. The filter of claim 1 where said first and second holes have substantially parallel center axes.

8. The filter of claim 1 where said input means is an area of conductive material substantially adjacent to said first inductor, on said top surface.

9. The filter of claim 1 where said output means is an area of conductive material substantially adjacent to said second inductor, on said top surface.

10. The filter of claim 1 where said first and second inductors have inductances that are substantially equal to each other.

11. A multistage monolithic ceramic block bandstop filter for suppressing desired frequency electrical signals comprising:

a filter body comprised of a block of dielectric material having at least top, side, and bottom surfaces, said filter body having at least first and second holes extending through said filter body, said holes having first ends at the top surface of said block and second ends at said bottom of said block, said filter body and interior surfaces of said first and second holes being substantially covered with a conductive material forming an electrical ground, with the exception of said top surface, said coated interior surfaces of said first and second holes having first and second inductances and forming first and second inductors, shorted to ground at their second ends, at at least one frequency;

an isolator within said filter body, suppressing electrical coupling between said first and second inductors comprised of a third hole extending at least partially through said block, located between said first and second holes, said third hole having a first end at said top surface and a second end at said bottom surface, surfaces within said third hole being substantially covered with conductive material that is electrically coupled at both said first and second ends to said conductive material coating surfaces of said filter body;

a first capacitor comprised of a layer of conductive material on the top of said block substantially surrounding conductive material covering the surfaces of the first hole but not contacting the conductive material covering the surfaces of the first hole, the first capacitor coupled to the first end of the first inductor, forming with said first inductor, at at least one frequency, a first series resonant circuit to ground;

a second capacitor comprised of a layer of conductive material on the top of said block substantially surrounding conductive material covering the surfaces of the second hole but not contacting the conductive material covering the surfaces of the second hole, the second capacitor coupled to the first end of the second inductor, forming with said second inductor, at at least one frequency, a second series resonant circuit to ground;

an impedance inverter means, coupled between the first and second capacitors, having first and second ends, for providing an impedance at one end that is substantially the mathematical inverse of an impedance at the opposite end.

12. The filter of claim 11 where said impedance inverter means is comprised of a predetermined length of wire, electrically coupling said input and output means and said first and second inductors, to each other.

13. The filter of claim 11 where said impedance inverter means is comprised of a predetermined length of printed conductive material on the top surface of the block, electrically coupling said input and output means and said first and second inductors, to each other.

14. The filter of claim 11 where said filter body is comprised of a block of dielectric material having the shape of a parallelpiped.

15. The filter of claim 11 where said first and second holes have substantially circular cross-sectional shapes.

16. The filter of claim 11 where said first and second holes have substantially elliptical cross-sectional shapes.

17. The filter of claim 11 where said first and second holes have substantially parallel center axes.

18. The filter of claim 11 where said first and second inductors have inductances that are substantially equal to each other.

19. A multistage monolithic ceramic block bandstop filter for suppressing desired frequency electrical signals comprising:

a filter body comprised of a block of dielectric material having at least top, side and bottom surfaces, said filter body having at least first and second holes extending through said filter body, said holes having first ends at the top surface of said block and second ends at said bottom of said block, said filter body and interior surfaces of said first and second holes being substantially covered with a conductive material forming an electrical ground, with the exception of said top surface, said coated interior surfaces of said first and second holes having first and second inductances and forming first and second inductors, shorted to ground at their second ends, at a first frequency;

an isolator within said filter body, suppressing electrical coupling between said first and second inductors comprised of a third hole extending at least partially through said block, located between said first and second holes, said third hole having a first end at said top surface and a second end at said bottom surface, surfaces within said third hole being substantially covered with conductive material that is electrically coupled at both said first and second ends to said conductive material coating surfaces of said filter body;

a first capacitor comprised of a layer of conductive material on the top of said block substantially surrounding conductive material covering the surfaces of the first hole but not contacting the conductive material covering the surfaces of the first hole, the first capacitor coupled to the first end of the first inductor, forming with said first inductor, at said first frequency, a first series resonant circuit to ground;

a second capacitor comprised of a layer of conductive material on the top of said block substantially surrounding conductive material covering the surfaces of the second hole but not contacting the conductive material covering the surfaces of the second hole, the second capacitor coupled to the first end of the second inductor, forming with said second inductor, at said first frequency a second series resonant circuit to ground; and a predetermined length of wire, having an electrical length that, in combination with at least said first and second capacitors, is substantially equivalent to a quarter-wavelength of transmission line at said first frequency.

* * * * *